United States Patent [19]

Strok

[11] 4,342,938

[45] Aug. 3, 1982

[54] UNIVERSAL BURNING CERAMIC LAMP

[75] Inventor: Jack M. Strok, Garrettsville, Ohio

[73] Assignee: General Electric Company, Schenectady, N.Y.

[21] Appl. No.: 135,953

[22] Filed: Mar. 31, 1980

[51] Int. Cl.[3] ..... H01J 61/24

[52] U.S. Cl. ..... 313/174; 313/225; 313/229

[58] Field of Search ..... 313/174, 217, 220, 225, 313/229

[56] References Cited

U.S. PATENT DOCUMENTS 3,825,788 7/1974 Pfaue et al. .
3,892,993 7/1975 Timmermans .
4,035,682 7/1977 Bubar .
4,052,636 10/1977 Strok ..... 313/229 X
4,065,691 12/1977 McVey ..... 313/174

*Primary Examiner*—Paul L. Gensler
*Attorney, Agent, or Firm*—Ernest W. Legree; Philip L. Schlamp; Fred Jacob

[57] ABSTRACT

A high pressure alkali metal vapor lamp envelope of alumina ceramic has an externally projecting metal tube serving as an inlead and as a reservoir for excess sodium-mercury amalgam. The ability of the lamp to withstand heavy vibration without the occurrence of voltage rise and drop-out caused by expulsion of amalgam droplets from the reservoir is enhanced by flattening the end portion of the metal tube to a least dimension adequate to increase the capillary attraction to better than twice the force of gravity.

6 Claims, 4 Drawing Figures

Fig. 1
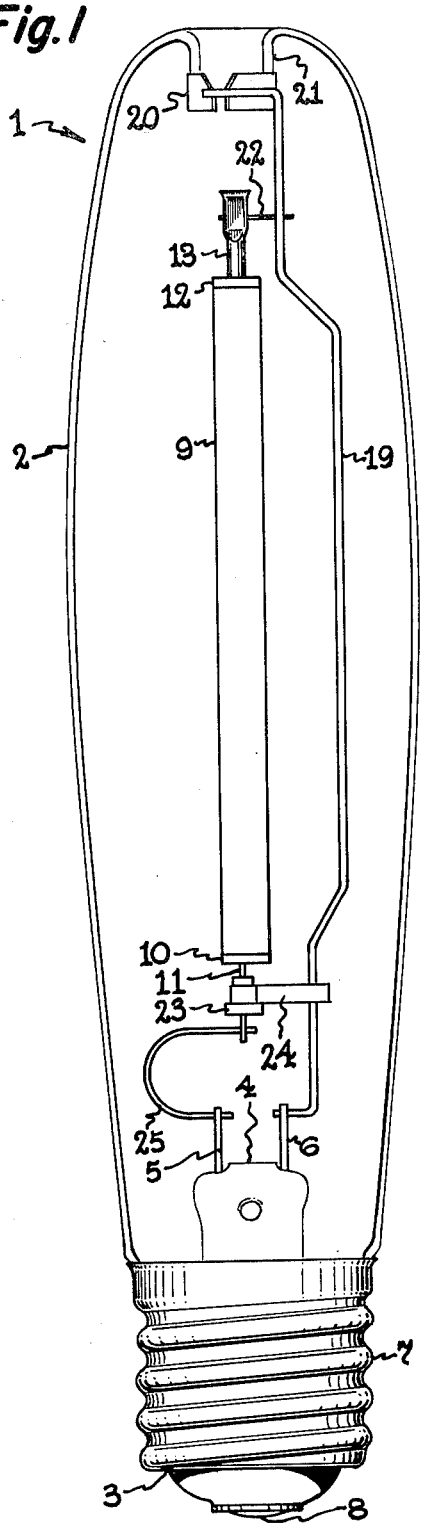
Fig. 2
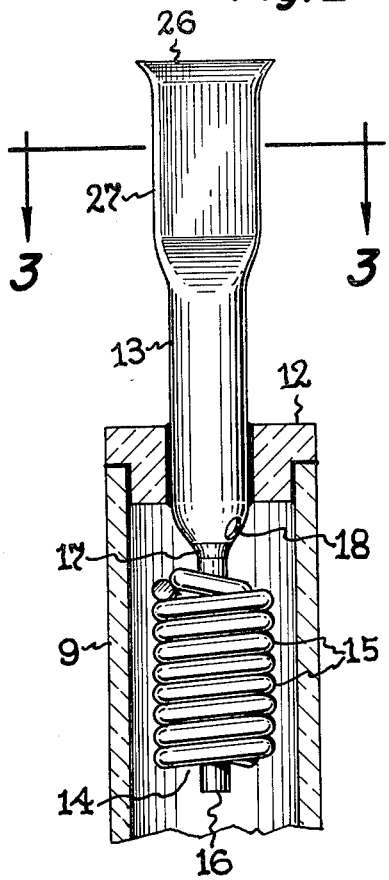
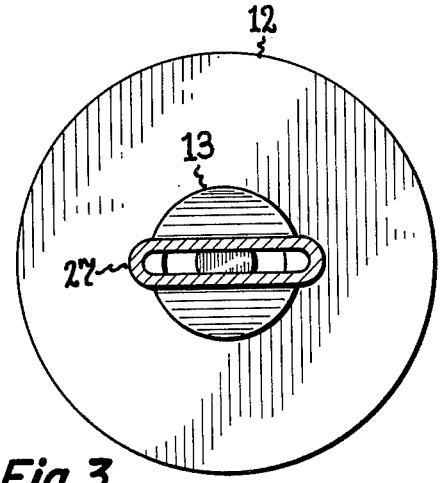
Fig. 3

UNIVERSAL BURNING CERAMIC LAMP

The invention relates to high pressure metal vapor discharge lamps utilizing alumina ceramic envelopes, and more particularly to such lamps intended for universal burning under high vibration conditions.

BACKGROUND OF THE INVENTION

The high intensity sodium vapor lamps with which the invention is most useful comprise a slender tubular ceramic arc tube which is generally mounted in an outer vitreous envelope or glass jacket. The arc tube is made of light-transmissive refractory oxide material resistant to sodium at high temperatures, suitably high density polycrystalline alumina or synthetic sapphire. The filling comprises sodium together with mercury for improved efficiency, along with a rare gas to facilitate starting. The ends of the tube are sealed by closure members through which connections are made to thermionic electrodes which may comprise a tungsten coil activated be electron emissive material. The outer envelope which encloses the ceramic arc tube is generally provided at one end with a screw base to which the electrodes of the arc tube are connected.

The high pressure sodium vapor lamp contains an excess amount of sodium mercury amalgam, that is it contains more amalgam than is vaporized when the lamp reaches a stable operating condition. By having an excess, the vapor pressure is determined by the lowest operating temperature at any point in the arc tube and the quantity supplied is not critical. Some of the excess amalgam is needed to replace any lost during life of the lamp as it ages, for instance by electrolysis through the alumina walls.

The location where the amalgam collects in a lamp depends upon the heat balance together with the effect of gravity. In lamps having a projecting metal exhaust tube which is sealed off, the tube may provide a reservoir for excess sodium-mercury-amalgam external to the arc tube proper. Such arrangement has the advantage of placing the excess amalgam in a location removed from the direct heat of the arc and of the electrode, so that arc tube blackening as the lamp ages has a minimal effect on sodium vapor pressure and on lamp voltage. Also the use of an external reservoir facilitates close adjustment of the heat balance in the lamp, as by grit-blasting a portion of the exterior of the metal tube in order to regulate the heat loss therefrom.

Provided the heat balance in the lamp makes the external reservoir the coolest point, the excess amalgam will condense there. Capillary attraction tends to retain the amalgam where it collects, and if the lamp is operated in an attitude such that the reservoir is lowermost, gravity also helps. However, mechanical shock or heavy vibration may cause a droplet of amalgam to fly from the exhaust tube toward the hotter arc tube, particularly when the lamp's orientation places the reservoir uppermost. Vaporization of the droplet then causes a sudden rise in vapor pressure and the corresponding increase in lamp voltage may be severe enough to extinguish the lamp. When the lamp goes out in this way, commonly called drop-out, it cannot be restarted until it has cooled and that may take from 1 up to 10 minutes, depending on the ambient temperature. In extreme cases, the relatively cool droplet has been known to cause thermal cracking of the arc tube where it strikes.

Various end construction for alkali metal vapor lamps have been proposed to prevent amalgam droplets from flying out of the reservoir under adverse conditions. In U.S. Pat. No. 4,035,682—Bubar, a fine mesh screen, friction-retained in the exhaust tube, prevents passage of liquid droplets. Any droplets impinging on the screen are slowly vaporized and recondensed at the tip. In U.S. Pat. No. 4,065,691—McVey, crimping of the exhaust tube at an intermediate point leaves only restricted channels communicating with the reservoir. The channels allow passage of the amalgam in vapor form but prevent its movement as a liquid. These measures have been successful enough to allow the commercial manufacture of universal burning sodium vapor lamps suitable for ordinary applications. However they are inadequate for installations subject to really high vibration such as on highway bridges, loading docks or in the vicinity of heavy machinery.

SUMMARY OF THE INVENTION

The object of the invention is to provide a new and improved universal burning ceramic lamp of the foregoing kind able to withstand conditions of excessive vibration without the occurrence of voltage rise and drop-out caused by expulsion of amalgam droplets from the reservoir into the arc tube or into higher temperature portions of the exhaust tube.

According to the invention, the foregoing is achieved by providing in the external metal exhaust tube a reservoir portion or chamber sufficient in volume to accommodate the entire quantity of excess amalgam and wherein the capillary attraction between chamber walls and amalgam charge is at least twice the force of gravity. The capillary attraction is increased to the desired level by making the least dimension in the chamber portion less than a certain value determined by the composition of the amalgam dose and the nature of the metal forming the chamber, that is its wettability by the amalgam.

In a preferred embodiment, the exhaust tube is a thin-walled niobium tube having an internal diameter of about 0.103". The chamber or reservoir is readily formed by flattening the end portion of the tube to a minimum transverse interior dimension of approximately 0.040" over a length of about 0.20". The resulting narrow chamber will provide a reservoir volume of about 0.001 cu in. This volume will accommodate a sodium-mercury-amalgam charge of up to about 40 milligrams with the capillary attraction better than 2 G's. Typical doses in high pressure sodium vapor lamps range from 20 to 30 milligrams, and sodium to mercury ratios range from 12 to 30% sodium by weight.

DESCRIPTION OF DRAWING

In the drawing:

FIG. 1 shows a high pressure sodium vapor lamp embodying the invention and suitable for universal burning under high vibration conditions.

FIG. 2 is an enlarged detail of the end closure and external reservoir.

FIG. 3 is a cross-section through the reservoir taken along line 3—3 in FIG. 2.

DETAILED DESCRIPTION

Figure 4:
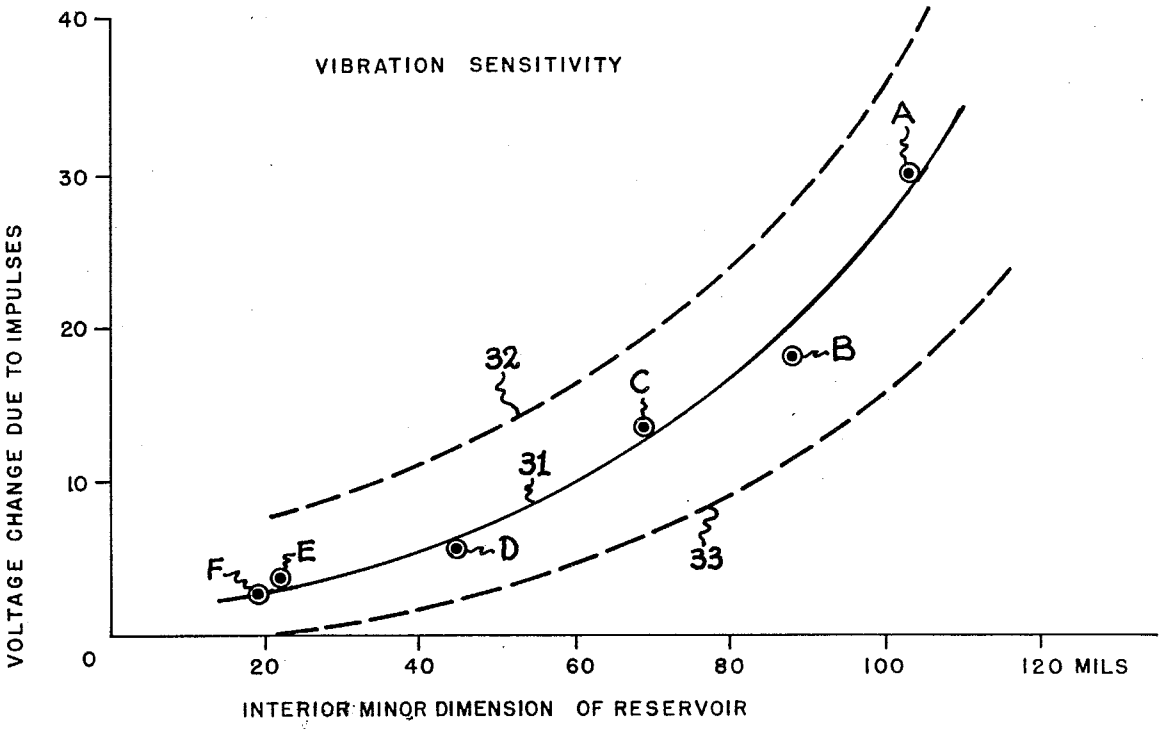
FIG. 4 is a graph showing the effect of pinch flattening on vibration sensitivity of the lamp.

A high pressure sodium vapor lamp 1 embodying the invention and corresponding to a 400 watt size is illustrated in FIG. 1. It comprises a vitreous outer envelope 2 with a standard mogul screw base 3 attached to the stem end which is shown lowermost. A reentrant stem 4 has a pair of relatively heavy lead-in conductors 5,6 extending through it whose outer ends are connected to the screw shell 7 and eyelet 8 of the base.

The inner envelope or arc tube 9 centrally located within the outer envelope comprises a length of light-transmitting ceramic tubing, suitably polycrystalline alumina ceramic which is translucent, or single crystal alumina which is clear and transparent. The lower end of the arc tube is closed by an alumina ceramic plug 10 through which extends hermetically a niobium inlead wire 11 which supports the lower electrode (not shown). The upper end closure also comprises a ceramic plug 12 through which extends a thin-walled niobium tube 13. It serves as an exhaust and fill tubulation during manufacture of the lamp, and as current inlead and external reservoir for excess sodium-mercury-amalgam in the finished lamp. The ceramic plugs are sealed to the ends of the tube and the niobium conductors 11 and 13 are sealed through the plugs by means of a glassy sealing composition comprising alumina and calcia which is fused in place.

Electrodes are provided at both ends of the arc tube similar to electrode 14 at the upper end, illustrated in FIG. 2. The electrode comprises tungsten wire 15 coiled on a tungsten shank 16 in two superposed layers. The shank is seized in the inwardly projecting end of niobium tube 13 either by crimping or by welding at 17; an aperture 18 allows passage of amalgam from the exhaust tube into the arc tube. The electrodes are activated by metal oxides, suitably dibarium-calcium tungstate, retained in the interstices between turns of the coiling. By way of example the illustrated lamp is a 400 watt size and the arc tube is 112 millimeters long by 7 millimeters in bore. The fill comprises a charge of 25 milligrams of amalgam of 25 weight percent sodium and 75 weight percent mercury, together with xenon at a pressure of 20 torr serving as a starting gas. However the benefits of the described invention may be obtained with any other wattage of high pressure sodium vapor lamp having similar external reservoir construction.

The arc tube is mounted within the outer envelope in a manner to allow for differential thermal expansion. A sturdy support rod 19 which extends substantially the length of the outer envelope is welded to lead-in conductor 6 at the stem end and braced by spring clamp 20 engaging nipple 21 in the dome end of the outer envelope. The arc tube is supported primarily by connector 22 which is welded across from niobium tube 13 to support rod 19. At the lower end, axial lead wire 11 extends through an insulating bushing 23 which is supported from rod 19 by means of metal strap 24. The aperture through the bushing allows free axial movement of inlead 11 and a flexible conductor 25 makes the electrical connection from the inlead to lead-in conductor 5. Differential thermal expansion is accommodated by axial movement of inlead 11 through the bushing and by flexing of curving conductor 25.

Lamps as so far described corresponding to the commercial product and utilizing, by way of example, intermediate crimping of the reservoir tube to prevent movement of the amalgam suffer from voltage rise and occasional drop-out when subjected to heavy vibration. The situation is particularly bad when the lamp's orientation or attitude in the fixture makes it horizontal or places the reservoir uppermost. Gravity assisted by vibration quite readily overcomes the surface tension that had been maintaining the liquid amalgam in place. The result is a dribbling or spattering of amalgam onto higher temperature areas of the exhaust tube or into the main body of the arc tube leading to rapid vaporization, steep voltage rise and likelihood of drop-out.

Attempts to solve the problem by reducing the weight of amalgam introduced into the arc tube achieved only marginal improvement in vibration tolerance. Furthermore, lamp life is potentially reduced because less sodium is available to replace the loss during life resulting from various "clean up" processes and normal diffusion through the walls of the alumina arc tube.

I have discovered a simple solution to the problem involving practically no increase in cost: it is to reduce the least internal dimension, throughout the outermost portion of the exhaust tube which accommodates the excess amalgam, enough to enable the increased capillary attraction to cope with the level of vibration expected. The most convenient way to do this is to flatten the end portion of the exhaust tube over a length sufficient to accommodate the excess amalgam in the flattened reservoir portion. The practice in lamp manufacture has been to seal the end of the niobium tube 13, after the amalgam charge has been introduced, through pinching jaws which apply sufficient pressure to effect a cold weld at 26. The only change required by my invention is to alter the shape of the pinching jaws to provide, in addition to the cold weld, the desired flattening of the end portion 27 as seen in cross-section in FIG. 3.

I have devised a laboratory testing procedure for measuring the effect of vibration on voltage rise. The lamp is installed in a socket which orients it horizontally and is started and allowed to come up to operating temperature. Light blows or impulses of constant magnitude at the rate of approximately two blows per second are struck on the lamp's outer jacket, about at the midpoint. The blows are vertical and transverse to the lamp's axis; by way of example, the blows may impart to the lamp outer jacket a peak acceleration of 4 G's, that is 4 times that of gravity. Calibration of the blows was made, prior to starting the lamp, by means of a resettable accelerometer which was attached to the lamp jacket. The voltage change recorded is the difference between the steady state value of voltage drop across the arc tube observed before application of the blows, and that observed during continuous application.

In the present commercial lamp product, the external reservoir is a tube of a niobium 1% zirconium alloy pinched shut by a cold weld at the outer end. The tube has an outer diameter of 0.123" and a wall thickness of 0.010" so that the least interior dimension is 0.103" except for the wedge-shaped end volume which cannot accommodate the entire excess of the 25 milligram charge of amalgam. By flattening an appreciable portion of the tube beyond the cold-welded end, a chamber is created within which the least transverse dimension is less than 0.103" and which can accommodate the entire excess. FIG. 4 shows the reduction in the voltage change caused by the 4G impulses as the reservoir is flattened more and more. Point A corresponds to the commercial product; points B, C, D, E and F correspond to least internal dimensions of 0.088", 0.070", 0.045", 0.022" and 0.019" respectively. Thus curve 31 joining the points A to F indicates the voltage change that can be expected for progressive degrees of flattening in the exhaust tube of the present product, which has a circular cross-section of 0.103" i.d. The dashed envelope lines 32 and 33 indicate the range or spread in a batch of lamps tested and shows wherein commercial production may be expected to lie. Flattening to an internal dimension from 0.060" to 0.020" increases the capillary retaining force on the amalgam to better than 2 G's and reduces the voltage sensitivity from about 30 volts to the range of about 10 to 3 volts. I find that a 5 volt variation under these test conditions corresponds to a product acceptable for high vibration applications. Accordingly I favor the corresponding minimal internal dimension of about 0.040". Further reduction in voltage variation would require lengthening of the niobium exhaust tube which would increase cost.

A lamp embodying my invention will have the outermost portion of the exhaust tube formed into a chamber of sufficient volume to accommodate the entire quantity of excess amalgam, and wherein the capillary attraction between chamber walls and the amalgam charge is better than 2G's. The capillary attraction is increased to the desired level by making the least dimension in the chamber less than a certain value which is determined by the composition of the amalgam dose and its capillary attraction for the metal of the exhaust tube. Since the choice of metal for the exhaust tube is limited by the requirement that it match reasonably the thermal expansion coefficient of alumina ceramic, there is little variation possible in the degree of capillary attraction through choice of metal. Therefore the least dimension must be controlled. The degree of flattening required can be reduced by using tubing of smaller bore. Also if tubing having an end portion formed to an internal diameter of about 0.040" is used, no flattening is necessary. Also instead of flattening, an inward deformation like a dent which consistently reduces the least internal dimension to the required value throughout the portion of the exhaust tube serving as the amalgam retaining chamber may be used.

What I claim as new and desire to secure by letters patent of the United States is:

1. An alkali metal vapor lamp comprising:

a tubular elongated envelope of light-transmitting ceramic material having a pair of electrodes sealed into opposite ends, one end of said envelope having a metal exhaust tube sealed thereto, said tube having a vent opening into the interior of said envelope and being sealed off at its outer end, an ionizable medium including mercury-alkali amalgam sealed within said envelope in a quantity exceeding that vaporized during operation of said lamp whereby an unvaporized excess remains in liquid form during operation, the heat balance in said envelope making the sealed end of said tube the cold spot in said envelope, and said tube having an end portion next to said sealed end serving as a reservoir for excess amalgam, said end portion being so dimensioned throughout a volume sufficient to accommodate said entire excess that the capillary attraction between the walls of the tube and the amalgam is better than 2 times the force of gravity.

2. A lamp as in claim 1 wherein said end portion of said tube is formed to a least internal dimension in the range of 0.060" to 0.020".

3. A lamp as in claim 1 wherein said end portion of said tube is formed to a least internal dimension in the range of 0.060" to 0.020" over an extent providing a volume accommodating from 20 to 30 milligrams of sodium-mercury amalgam containing from 12% to 30% sodium by weight.

4. A lamp as in claim 1 wherein said end portion of said tube is flattened to a least transverse dimension in the range of 0.060" to 0.020".

5. A lamp as in claim 1 wherein said end portion of said tube is flattened to a least transverse dimension in the range of 0.060" to 0.020" over a length sufficient to accommodate from 20 to 30 milligrams of sodium-mercury amalgam containing from 12% to 30% sodium by weight.

6. A lamp as in claim 1 wherein said end portion of said tube is flattened to a least transverse dimension of approximately 0.040" over a length sufficient to accommodate from 20 to 30 milligrams of sodium-mercury amalgam containing from 12% to 30% sodium by weight whereby to reduce lamp voltage variation under heavy vibration to less than 5 volts.

* * * * *